US005321867A

United States Patent [19]

Probst

[11] Patent Number: 5,321,867

[45] Date of Patent: Jun. 21, 1994

[54] FOOT WASHING APPARATUS

[76] Inventor: John F. Probst, 7200 Jonathan Dr., Hudson, Ohio 44236

[21] Appl. No.: 32,129

[22] Filed: Mar. 17, 1993

[51] Int. Cl.[5] ..... A46B 5/00

[52] U.S. Cl. ..... 15/160; 15/161; 4/606; 601/136

[58] Field of Search ..... 15/112, 161, 104.92, 15/160; 4/606; 128/62 R

[56] References Cited

U.S. PATENT DOCUMENTS

| | | | |
|---|---|---|---|
| 154,715 | 9/1874 | Reed | 15/112 |
| 850,396 | 4/1907 | Polt | 15/161 |
| 895,458 | 8/1908 | Herzog | 15/112 |
| 2,210,365 | 8/1940 | Gilpin | 15/161 |
| 2,591,331 | 4/1952 | Baumbach | 15/161 |
| 4,189,189 | 2/1980 | Lewis, Jr. | 300/7 |
| 4,291,431 | 9/1981 | Lewis, Jr. | 15/159.1 |
| 4,348,060 | 9/1982 | Lewis, Jr. . | |
| 4,532,668 | 8/1985 | Slonicki | 15/161 |
| 4,617,917 | 10/1986 | Miller | 15/161 |
| 4,693,519 | 9/1987 | Lewis, Jr. . | |
| 4,772,073 | 5/1987 | Lewis, Jr. . | |

FOREIGN PATENT DOCUMENTS

| | | | |
|---|---|---|---|
| 21487 | 4/1883 | Fed. Rep. of Germany | 15/112 |

*Primary Examiner*—Philip R. Coe
*Assistant Examiner*—Mark Spisich
*Attorney, Agent, or Firm*—Roger D. Emerson

[57] ABSTRACT

A device for washing a person's feet while the person is standing in an upright position includes a housing and brushes. The housing has a bottom wall first and second side walls and an open front end and rear end. The brushes include bottom brushes which are attached to the bottom wall, front side brushes which are attached to the side walls near the front end of the housing and rear side brushes which are attached to the side walls near the rear end of the housing. The device includes suction cups or the like for securing the housing to the floor of the shower or similar floor surface. The device is used by placing liquid soap or other cleaning agents into the housing while keeping both hands free to hold on to the shower walls, railing, or the like. A person using the device places their foot within the housing and moves it back and forth past the bottom brushes, front side brushes, and rear side brushes to clean the foot thoroughly. Through this method and device, the person's foot can be thoroughly cleansed without need for the person to use either arm or hand for the cleansing of their feet.

1 Claim, 2 Drawing Sheets

FOOT WASHING APPARATUS

BACKGROUND OF THE INVENTION

1. Field of Invention

This invention relates to devices of manufacture for washing a person's feet, and more particularly to devices which can be used to wash a person's feet while they are in an upright position in areas as showers, swimming pools, and wherever it would be desirable for a person to wash their feet while remaining in an upright position.

2. Description of the Related Art

Many persons prefer washing in a shower rather than taking a bath. Since a person showers in an upright position, standing on both feet, to effectively wash their feet it is necessary to stand on one foot while lifting the other foot off the floor and washing it.

However, standing upright on one foot to wash the other foot is known to have caused many injuries. Because the floor or surface which is stood upon is slippery, due to the presence of the water, footing is already difficult. Standing upright under a stream of water on one foot while holding the other foot with one or both hands is a balancing act many people are unable to maintain.

The invention disclosed herein addresses these deficiencies in the prior art. The inventor of the disclosed invention is aware of no other invention having the particular form and attributes described and claimed herein. The inventive article of manufacture is preferably made of plastic so that it is durable in a wet environment. The use of the apparatus allows both hands to be free to grip stabilizing objects like the shower walls or handrails. By freeing both of the person's hands, the person has three points (two hands and one foot) with which to balance himself.

SUMMARY OF THE INVENTION

In accordance with the present invention, a new and improved article of manufacture is provided which is effective to overcome the above-described difficulties of the prior art.

Particularly, in accordance with the invention, the inventive device includes a housing and bottom brushes. The housing has a bottom and first and second side wall. Each of the bottom and first and second side walls has an interior and exterior surface and also a front and a rear end. The bottom brushes are fixedly attached to the interior surface of the bottom wall so that a user's foot can be received into the housing and moved relative to the bottom brushes, thereby cleaning the foot while the user is in a standing position.

According to a further aspect of the invention, the device also includes front side brushes which are fixedly attached beside walls near the front end of the side walls. The device also includes rear side brushes which are fixedly attached to the side walls near the rear end of the side walls.

According to a still further aspect of the invention, the device includes securing means for securing the housing to floor surface. The securing means are affixed to an exterior surface of the bottom wall. In one preferred embodiment, the securing means comprises suction cups.

One advantage of the present invention is the provision of a new foot washing device which can be used to wash the user's feet while the user remains in a standing or upright position.

Another advantage of the invention is its low cost. Because it is made of plastic and is of relatively simple design, the device can be manufactured inexpensively and made available to a wide variety of consumers.

Another advantage of the present invention is its attractive appearance. Due to its design as disclosed herein, as well as the material of which it is manufactured, the device can be made in variety of colors and patterns to coordinate the surroundings in which it would be used.

Another advantage of the present invention is its effectiveness. Due to the design of the device and the brushes therein, the users foot can be cleansed more effectively than by devices of manufacture or washing methods.

Another advantage of the present invention is the improved health to the user due to the thoroughness of the cleansing as described above.

Another advantage of the present invention is the safe manner in which it can be used. Rather than requiring the user to use both hands to clean an up-raised foot, the user of the inventive device is able to keep one or both feet in a weight-bearing position while keeping both hands on a wall, railing, handle, or other weight-supporting and balance-providing device.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
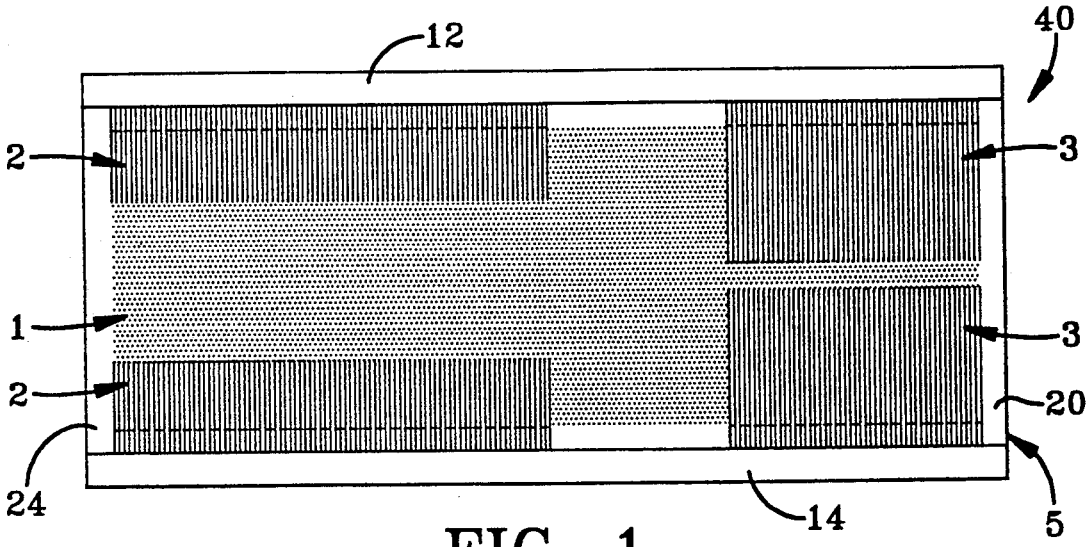
FIG. 1 is a top view of a device according to the invention.

Referring now to the drawings wherein the showings are for purposes of illustrating a preferred embodiment of the invention only and not for purposes of limiting the same, FIGS. 1–4 disclose the preferred embodiment of the inventive device 40.

Figure 2:
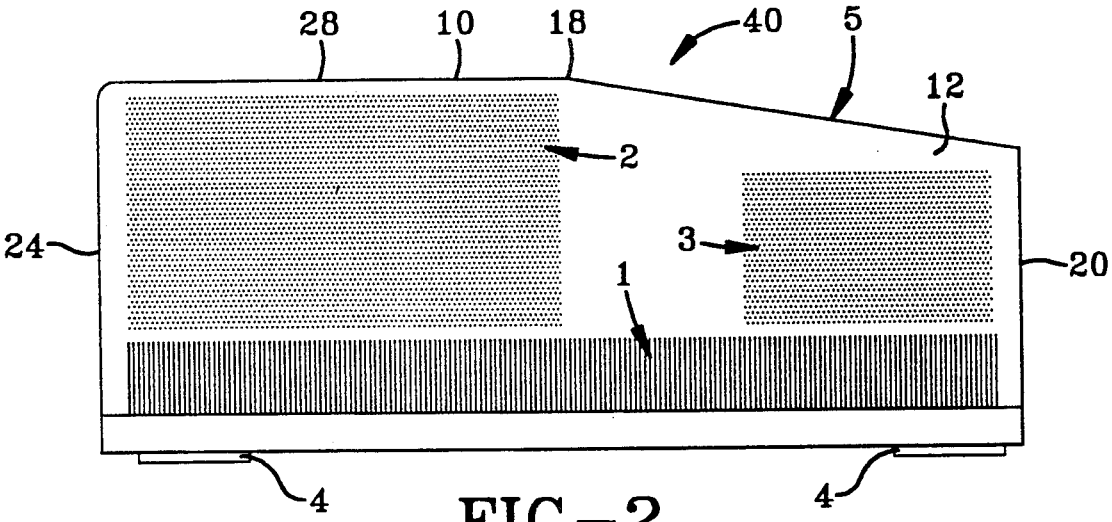
FIG. 2 is a side elevational view of a device according to the invention.

The primary elements of the device 40 are bottom brushes 1, rear side brushes 2, front side brushes 3, suction cups 4, and housing 5. With particular reference to FIG. 2, it can be seen that, in the preferred embodiment, the top surface 10 of the first and second side walls 12,14 is not of uniform height but instead has an inflection point 18 at which the top surface 10 of the first and second side walls 12,14 angles downwardly toward a front end 20 of the housing 5. As it is seen most clearly in FIG. 2, the inflection point 18 and angled top surface 10 of the first and second side walls 14,16 roughly simulate the downward slope of the arch of a human foot. A rear end 24 of the housing 5 receives the user's foot which is swung forwardly toward the front 20 of the housing 5.

With continuing reference to FIG. 2, the relative dimensions of the brushes 1,2,3 are seen. In the preferred embodiment, the height of the bristles of the bottom brush 1 is equal to one inch. The rearmost portion 28 of the top surface 10 of the housing 5 is of uniform height. In the preferred embodiment, the rearmost portion 28 of the top surface 10 of the front end 20 of the housing 5 is five inches in height with the overall length of the housing 5 being thirteen inches and the width of the housing 5 being five and one half inches. The height of the front end 20 of the housing 5 is four inches.

Figure 3:
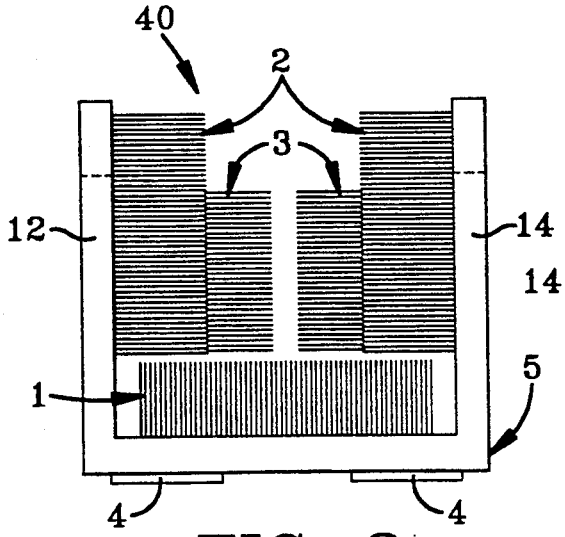
FIG. 3 is a rear end view of a device according to the invention.
Figure 4:
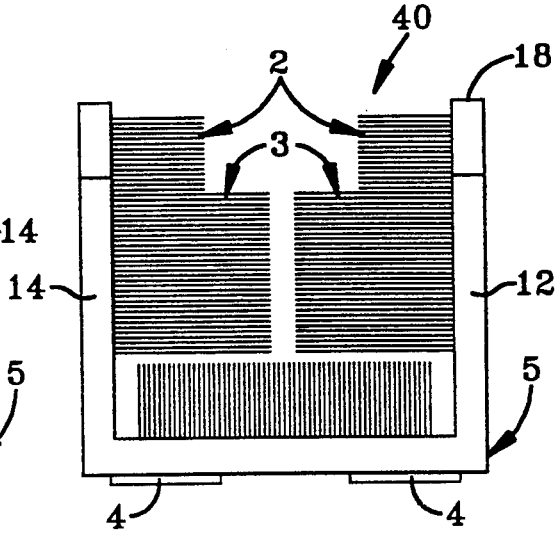
FIG. 4 is a front end view of a device according to the invention.
Figure 5:
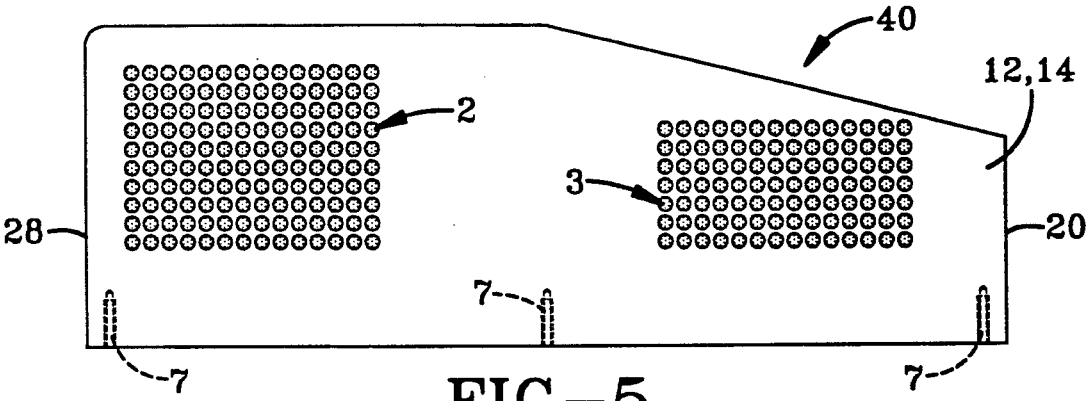
FIG. 5 is a side elevational view of an alternate embodiment of the invention.
Figure 6:
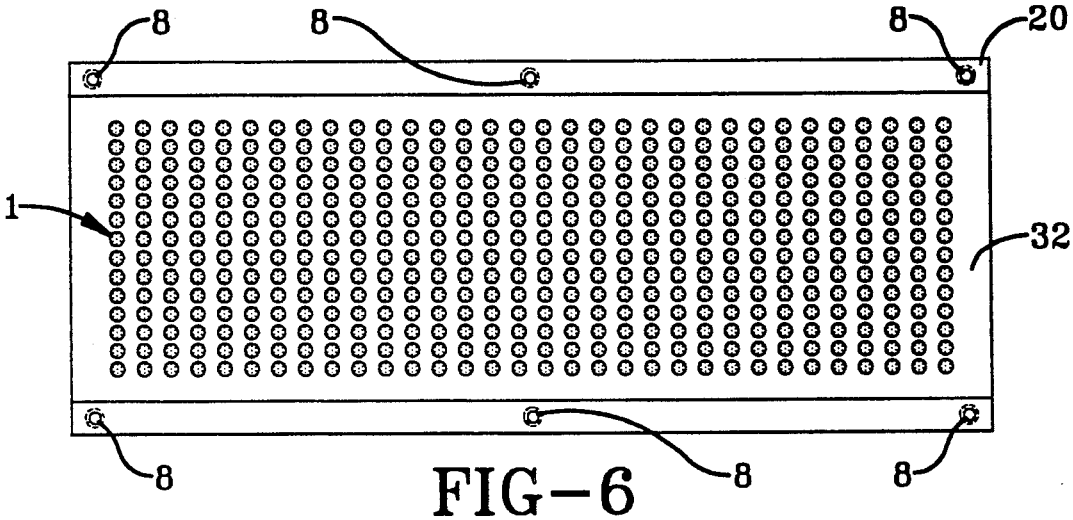
FIG. 6 is a top view of an alternate embodiment of the invention.
Figure 7:
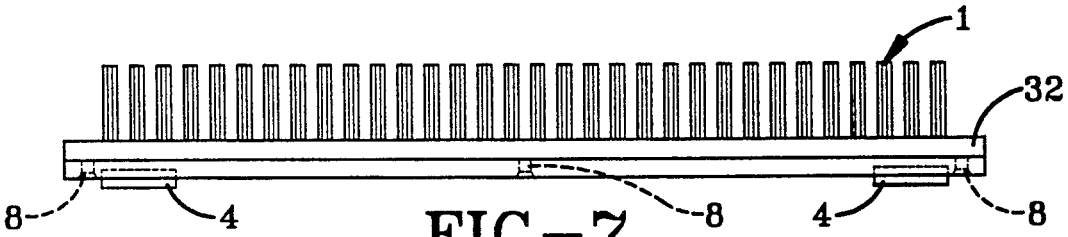
FIG. 7 is a side elevational view of a portion of an alternate embodiment of the invention.
Figure 8:
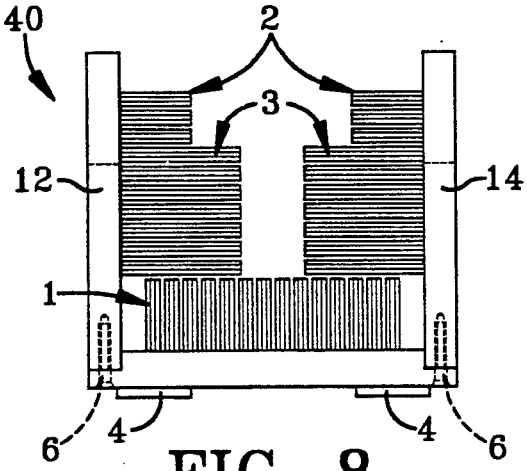
FIG. 8 is a rear end view of an alternate embodiment of the invention.
Figure 9:
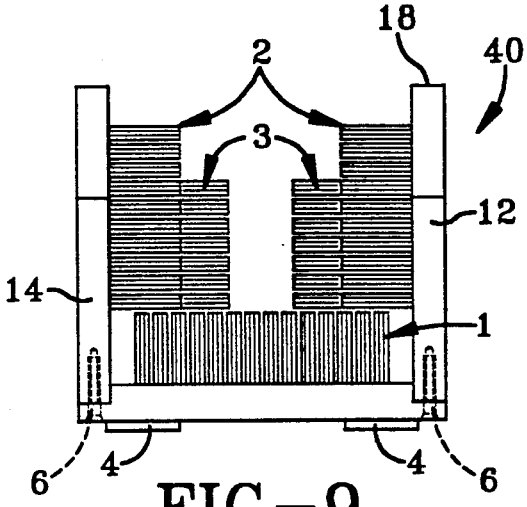
FIG. 9 is a front end view of alternate embodiment of the invention.

With reference to FIGS. 3 and 4, the relative length of the bristles of the rear side brushes 2 and front side brushes 3 can be seen. The length of the front side brushes 3 is two and one fourth inches of length of the rear side brushes 2 is one and one fourth inches. The length differential between the side brushes 2,3 is best seen in FIGS. 3 and 4. Also evident from those views is the height differential between the front side brushes 3 and the rear side brushes 2. With reference to FIGS. 2–4, it can be seen that the front side brushes 3 are lower than the rear side brushes 2. In a preferred embodiment, the rear side brushes 2 are three and one fourth inches high while the front side brushes 3 are two and one fourth inches high. With reference to FIG. 2, the length of the front side brushes 3 is three and one half inches while the length of the rear side brushes 2 is six inches.

In the preferred embodiment the housing 5 is made of plastic. Plastic was chosen because of its good performance in a wet environment, its low cost, and many attractive colors and features which can be molded into the housing through the use of plastic. In preferred material for brushes is nylon although any material chosen with good engineering judgement can be used.

The housing 5 can be secured to the floor surface (not shown) through any securing means chosen with sound engineering judgment. Among these means could be hook and pile strips, such as those sold under the Registered Trademark VELCRO ®, suction cups, for a temporary connection or a more permanent attachment such as with screws.

The operation of the inventive device 40 is as follows:

The device 40 is mounted on floor for the securing means. In one common application the device 40 could be brought into the shower and attached to the floor of the shower stall. Preferably, a small amount of liquid soap is then placed within the housing 5. A person wishing to wash one of his feet would then stand, at least primarily, on one foot while placing the other foot within the device 40. The toes of the person's foot would enter the front end 20 of the housing 5, go past the rear side brushes 2, and continue thorough it until the toes are between the front side brushes 3. At this time, the person may choose to place both hands on the walls or a railing, thus providing himself three points of balance and steadying himself for the next step of the foot washing process. The person's foot is then moved back and forth between the front side brushes 3, rear side brushes 2, and bottom brushes 1. By doing so, the liquid soap is lathered in the brushes 1,2,3 and the device 40 effectively and thoroughly cleans the user's feet.

When the user's foot is thusly cleaned, it can be withdrawn from the housing 5 and rinsed in the shower stream. The process is then repeated for the person's other foot.

With reference to FIGS. 5–9, an alternate embodiment of the invention is shown. In this embodiment, the housing 5 is constructed with screws 6. The screws 6 are received into holes 7,8. In this embodiment, the bristles of the brushes 1,2,3 are molded into the respective side walls 12, 14 and bottom 32. In this embodiment, in addition to the screws 6, the elements of the device 40 are also held together with a plastic cement. The plastic cement is located at the interface of side walls 12,14 and bottom 32.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A device for washing one's feet while in a standing position, said device comprising:

a housing, said housing having an elongated bottom wall having spaced lateral edges, first and second elongated side walls being connected to said bottom wall at respective lateral edges of said bottom wall and forming a channel-like structure to receive a human foot, said housing having a centerline bisecting said bottom wall between said side walls, each of said bottom, first and second walls having an interior and exterior surface and also having opposite front and rear ends said side walls at said front end each having an upper surface spaced from said bottom wall by a first distance and said side walls at said rear end each having an upper surface spaced from said bottom wall by a second distance, said second distance being greater than the first distance, said housing having no top and being open at said front and rear ends to allow said foot to be swung through said housing;

rear side brushes, said rear side brushes being fixedly attached to respective interior surfaces of said side walls near said rear end of said side walls;

front side brushes, said front side brushes being fixedly attached to respective interior surface of said side walls near said front end of said side walls, said front side brushes having free ends extending further inwardly toward said axial centerline of said housing than the free ends of said rear side brushes, said rear side brushes each having an upper surface spaced a greater distance from said bottom wall than an upper surface of each of said front side brushes;

a bottom brush, said bottom brush being fixedly attached to said interior surface of said bottom wall; and, securing means for securing said housing to a shower floor, said securing means affixed to said exterior surface of said bottom wall.

* * * * *